US007159260B2

(12) United States Patent
Hansen

(10) Patent No.: US 7,159,260 B2
(45) Date of Patent: Jan. 9, 2007

(54) MULTI-PURPOSE TRUCKER'S POWER-PULLER TOOL

(76) Inventor: Dennis Hansen, Box 1794, Lewiston, ID (US) 83501

( * ) Notice: Subject to any disclaimer, the term of this patent is extended or adjusted under 35 U.S.C. 154(b) by 42 days.

(21) Appl. No.: 11/140,144

(22) Filed: May 27, 2005

(65) Prior Publication Data

US 2005/0278867 A1 Dec. 22, 2005

Related U.S. Application Data

(60) Provisional application No. 60/575,274, filed on May 28, 2004.

(51) Int. Cl.
*B25D 1/00* (2006.01)
*B25F 1/02* (2006.01)
*B66F 19/00* (2006.01)

(52) U.S. Cl. ..... 7/143; 7/100

(58) Field of Classification Search ..... 7/100, 7/143; 254/129, 131; 81/177.2, 177.4, 177.5, 81/53.1

See application file for complete search history.

(56) References Cited

U.S. PATENT DOCUMENTS 3,843,981 A * 10/1974 Verest ..... 7/170
4,050,107 A * 9/1977 Parma ..... 7/100
4,778,181 A * 10/1988 Arney ..... 463/47.4
5,129,529 A * 7/1992 Manyek ..... 213/166
5,171,052 A * 12/1992 Cunningham ..... 294/19.1
D332,382 S * 1/1993 Westcott ..... D8/89
D333,603 S * 3/1993 Eagle, Jr. ..... D8/89
5,285,543 A * 2/1994 Rowe ..... 7/138
5,344,201 A * 9/1994 Offin ..... 294/24
5,378,007 A * 1/1995 Joyce ..... 280/433
D370,605 S * 6/1996 Schimeneck et al. ..... D8/14
5,803,518 A * 9/1998 Gibbons ..... 294/18
6,092,825 A * 7/2000 Flater ..... 280/433

* cited by examiner

*Primary Examiner*—David B. Thomas
(74) *Attorney, Agent, or Firm*—Duncan Palmatier

(57) ABSTRACT

A multi-purpose trucker's power puller tool with a hook rod that slides in the bore of a handle, and a weighted head at an end of the handle. The weighted head provides momentum to the hooked end for yanking free stuck objects, such as a truck's fifth wheel pin. The slidable rod also allows the tool to be locked in extended or collapsed positions. The invention also allows interchangeable hook rods to be used, so that the tool may be adapted to different purposes, such as grabbing and pulling eyelets of truck load covers, or pulling chains.

14 Claims, 9 Drawing Sheets

MULTI-PURPOSE TRUCKER'S POWER-PULLER TOOL

CLAIM OF PRIORITY TO PROVISIONAL APPLICATION (35 U.S.C. § 119(e))

This application claims priority under 35 U.S.C. § 119(e) from provisional patent Application No. 60/575,274, filed May 28, 2004. The 60/575,274 Application is incorporated herein by reference.

FIELD OF THE INVENTION

The present invention relates to a trucker's multi-purpose tool, and more specifically to a truck fifth wheel pin puller tool which may also be adapted for use as a tarp and chain grabber and puller and as a tire thumper.

DISCUSSION OF PRIOR ART

Several patents show truck fifth wheel pin puller tools. Design Pat. No. Des. 311,312 ("the '312 design patent"), issued on Oct. 16, 1990, entitled "Combined Fifth Wheel Pin Puller and Tire Knocker", shows what claims to be an ornamental design for such a trucker's tool. The design has a cylindrical head, an elongated rod, a paddle extending out from the rod, and a crook. Although not discussed in this design patent, truckers will recognize that the crook is for hooking onto and pulling out the fifth wheel pin and the head is for thumping tires to check for excessively low pressure. The fifth wheel pin pulling function may be seen more fully in FIG. 7 of Design Pat. No. Des. 330,494 ("the '494 design patent"), issued on Oct. 27, 1992, entitled "Fifth Wheel Pin Puller". The '494 patent, and another design patent by the same inventor, Design Pat. No. Des. 333,603 ("the '603 patent"), entitled "Fifth Wheel Pin Puller", show extendable pin pullers. Another design patent by the same inventor of the '312 design patent shows a "Combined Fifth Wheel Pin Puller and Tire Knocker For Tractor Trailer Hitch Assemblies", shows what claims to be another ornamental design for such a tool. See Design Pat. No. Des. 311,482 ("the '482 design patent"), issued on Oct. 23, 1990. From the drawings of the '482 design patent, the tool has a crook at one end of the rod for grabbing a truck's fifth wheel pin, a transverse, cylindrically-shaped head for pulling the pin and thumping tires, and a spring-mounted sleeve over the rod.

The prior art patents show what are claimed to be ornamental designs for fifth wheel pin pullers. These designs do not address the utilitarian problems involved. Often, a fifth wheel pin will become stuck and will be very difficult to remove. The prior art does not address this problem. Truckers cannot carry every conceivable tool they may need, so multi-purpose tools are important. The '312 and '482 design patents provide fifth wheel pin pullers combined with tire thumpers, but the pin crook will not work for many of the other pulling needs of a trucker. For example, truckers often need to pull canvas covers over a truck load. The covers have eyelets for securing them over the cargo. The crook of the '312 and '482 design patents is too difficult to get into an eyelet and too difficult to remove from an eyelet. The acute angle hook of the '494 and '603 design patents is more suitable for this cover pulling function, but will tend to come out of the fifth wheel pin as the trucker prepares to yank on it to remove the pin. Both the crook and acute angle hook designs of the design patents identified above work less well than a right angle bend for certain other functions commonly performed by truckers, such as pulling chains. What is needed is a multi-purpose tool design that will provide interchangeable hooks to perform different functions. Another problem with the prior art is that a long pin puller is difficult to store. The '494 and '603 designs provide a collapsible rod, but the design will not allow different hooks to be used.

SUMMARY OF THE INVENTION

One of the objects of the present invention is to provide a multi-purpose trucker's power puller tool that will use a weighted head on a sliding handle rod to provide momentum for pulling fifth wheel pins.

Another object of the present invention is to provide a multi-purpose trucker's power puller tool with interchangeable hooks for different functions, such as pulling a fifth wheel pin with a crook, inserting an acute angle hook into an eyelet to pull a cover over a load, and grabbing a chain with a right angle bend.

Another object of the present invention is to provide a multi-purpose trucker's power puller tool that can be collapsed and locked in a shorter length for storage.

Another object of the present invention is to provide a multi-purpose trucker's power puller tool with a tire thumper.

DETAILED DESCRIPTION OF THE PREFERRED EMBODIMENTS

LISTING OF REFERENCE NUMBERS

Figure 1:
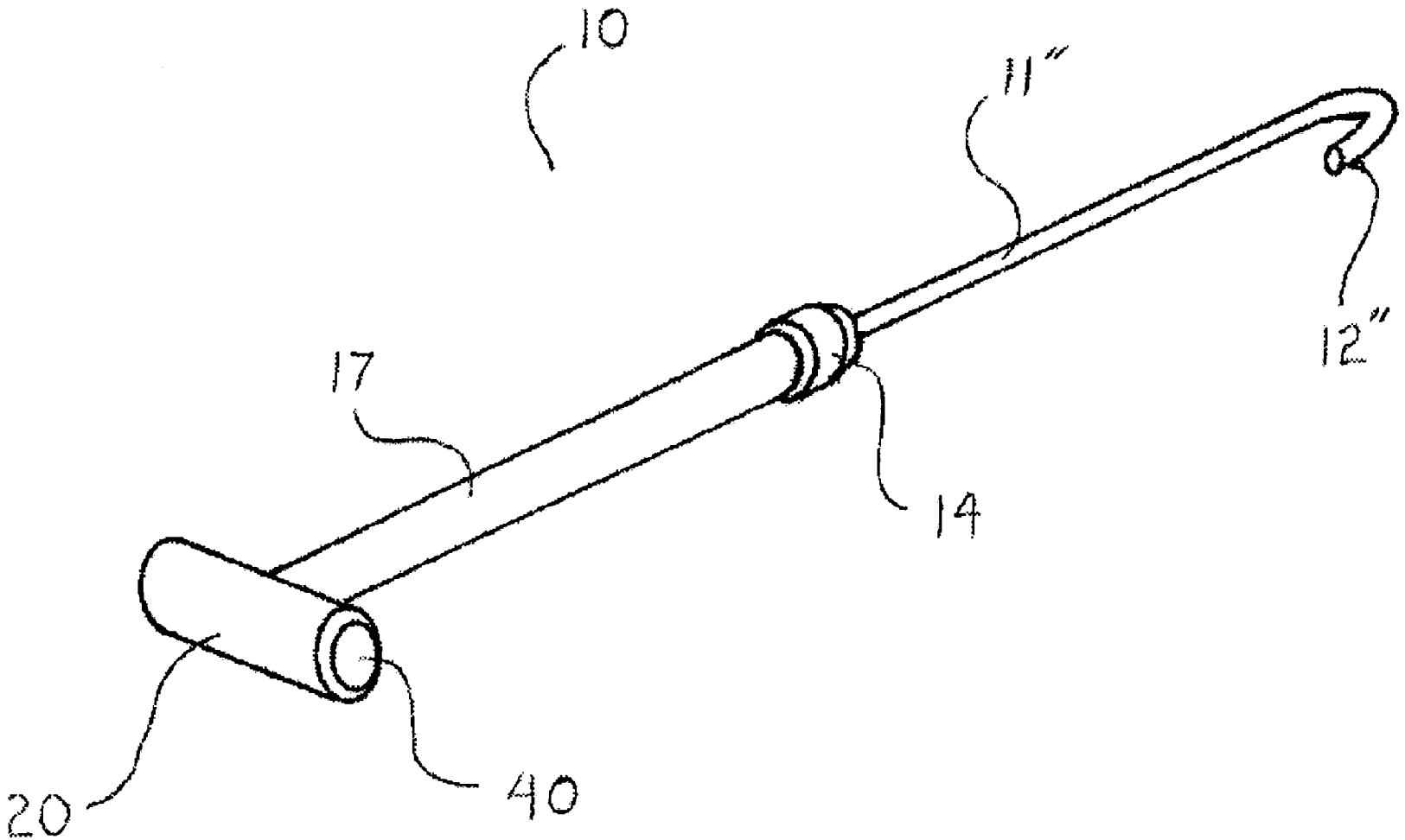
FIG. 1 is a perspective view of the multi-purpose trucker's power tool of the present invention.

10 Multi-purpose trucker's power-puller tool
11 Hook rod
11' First alternative embodiment of hook rod
11" Second alternative embodiment of hook rod
12 hook
12' First alternative embodiment of hook
12" Second alternative embodiment of hook
13 threaded end of rod
14 Lock nut at threaded end of handle
15 Wedge lock
16 Nut at threaded end of rod
17 Handle
18 Threaded end of handle
19 Head end of handle
20 Head

Figure 2:
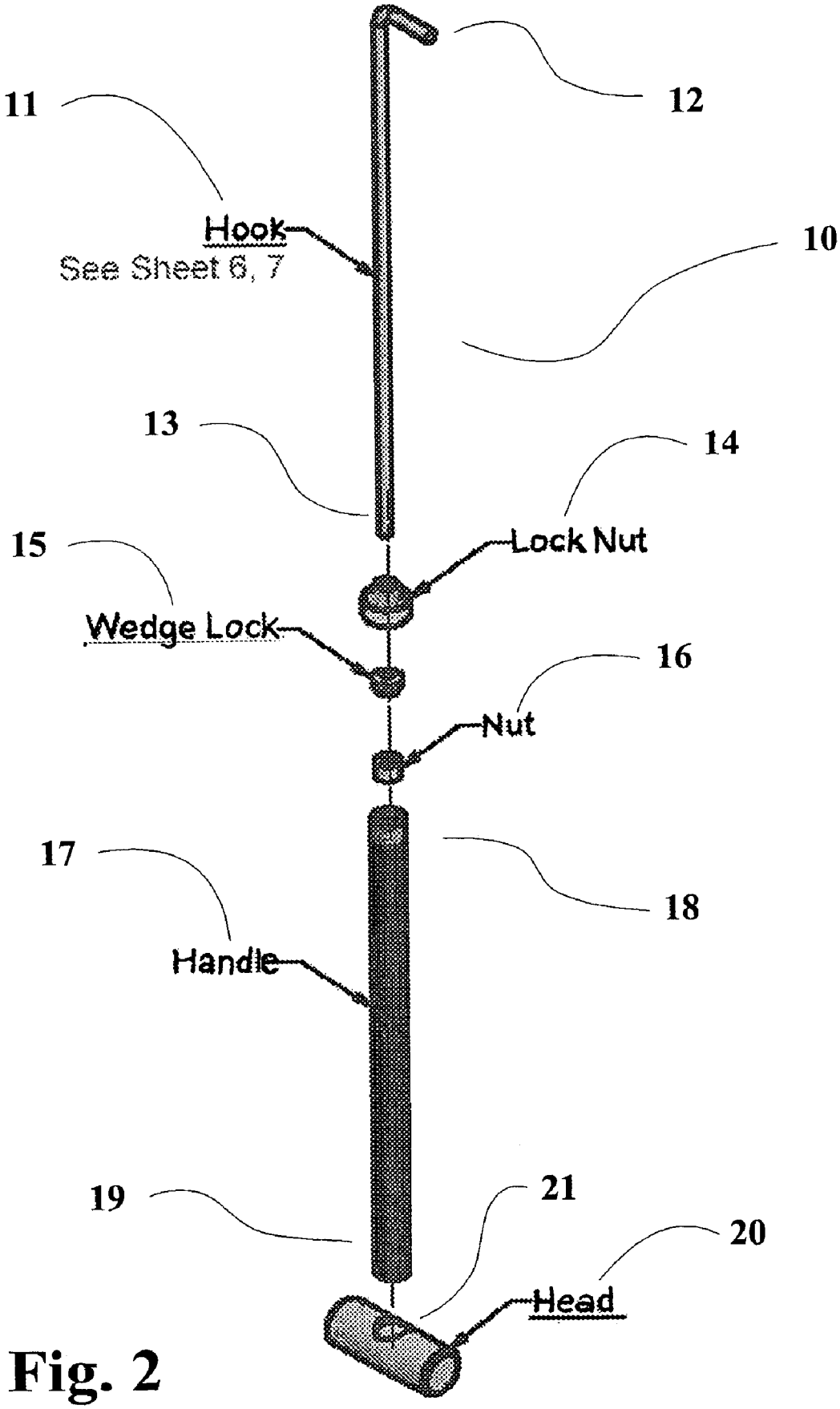
FIG. 2 is an exploded view of the multi-purpose trucker's power tool of the present invention.
Figure 3:
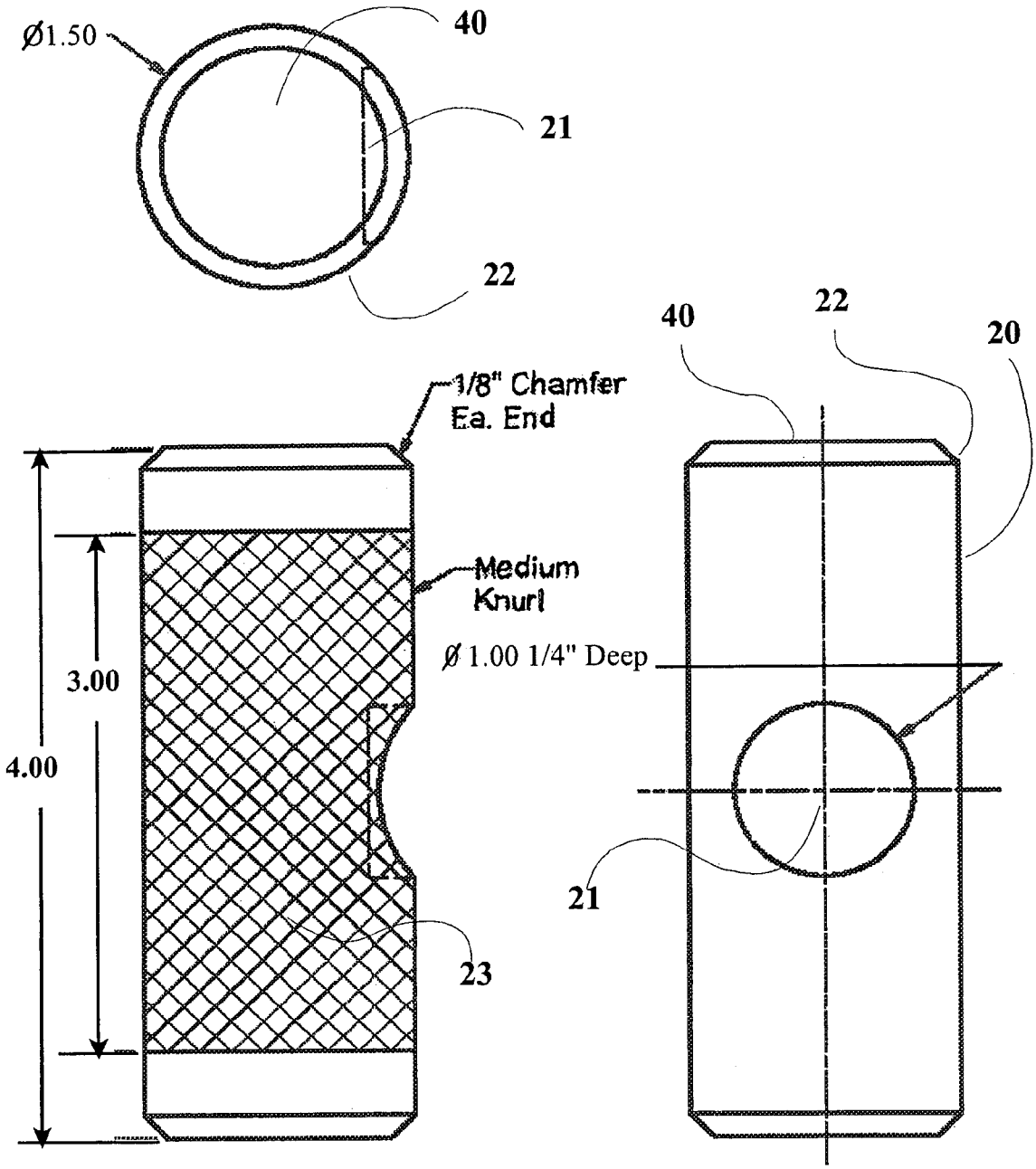
FIG. 3 shows three views of the head portion of the present invention.
Figure 7:
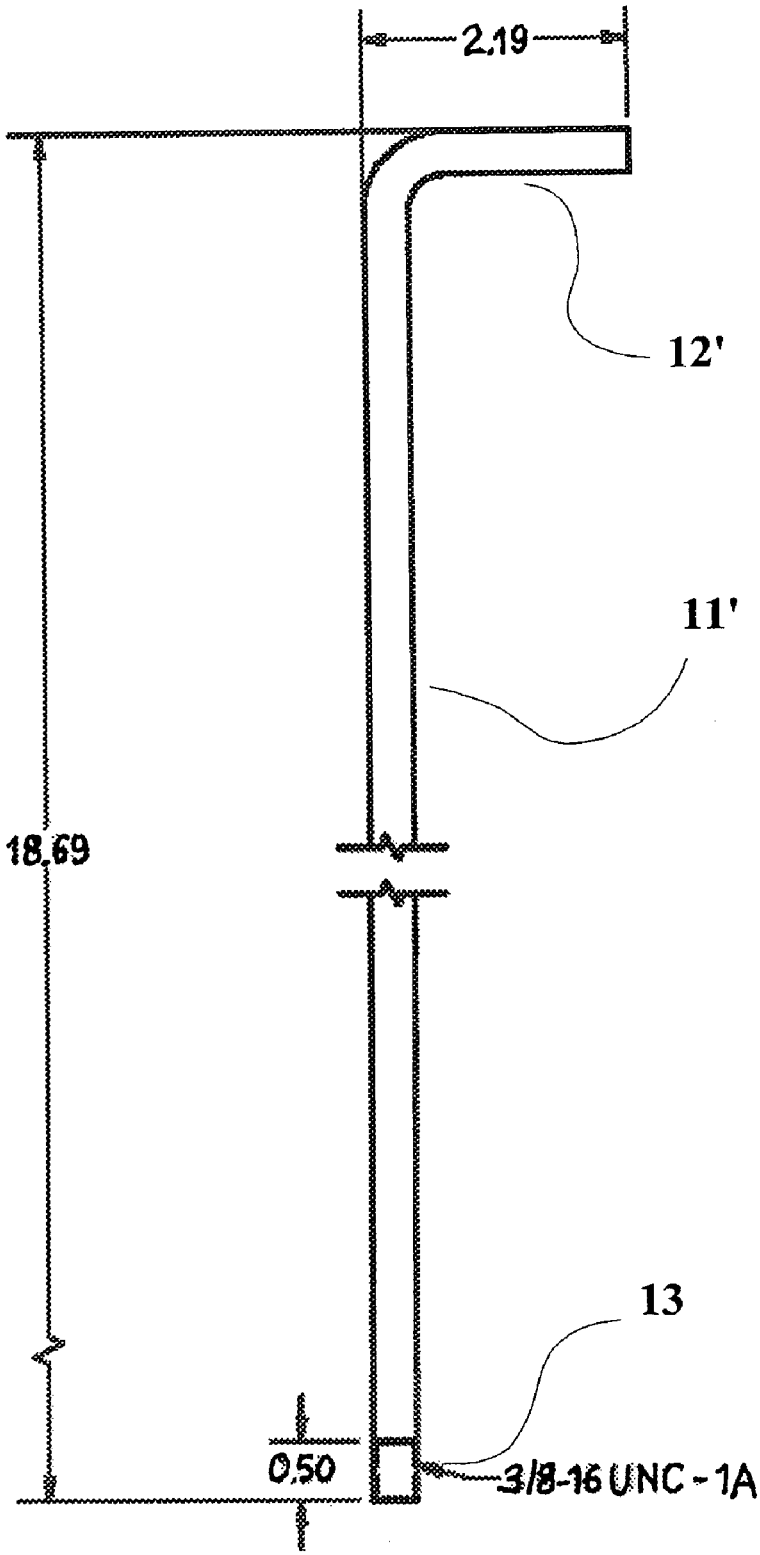
FIG. 7 shows an alternative embodiment of the hook portion of the present invention.
Figure 8:
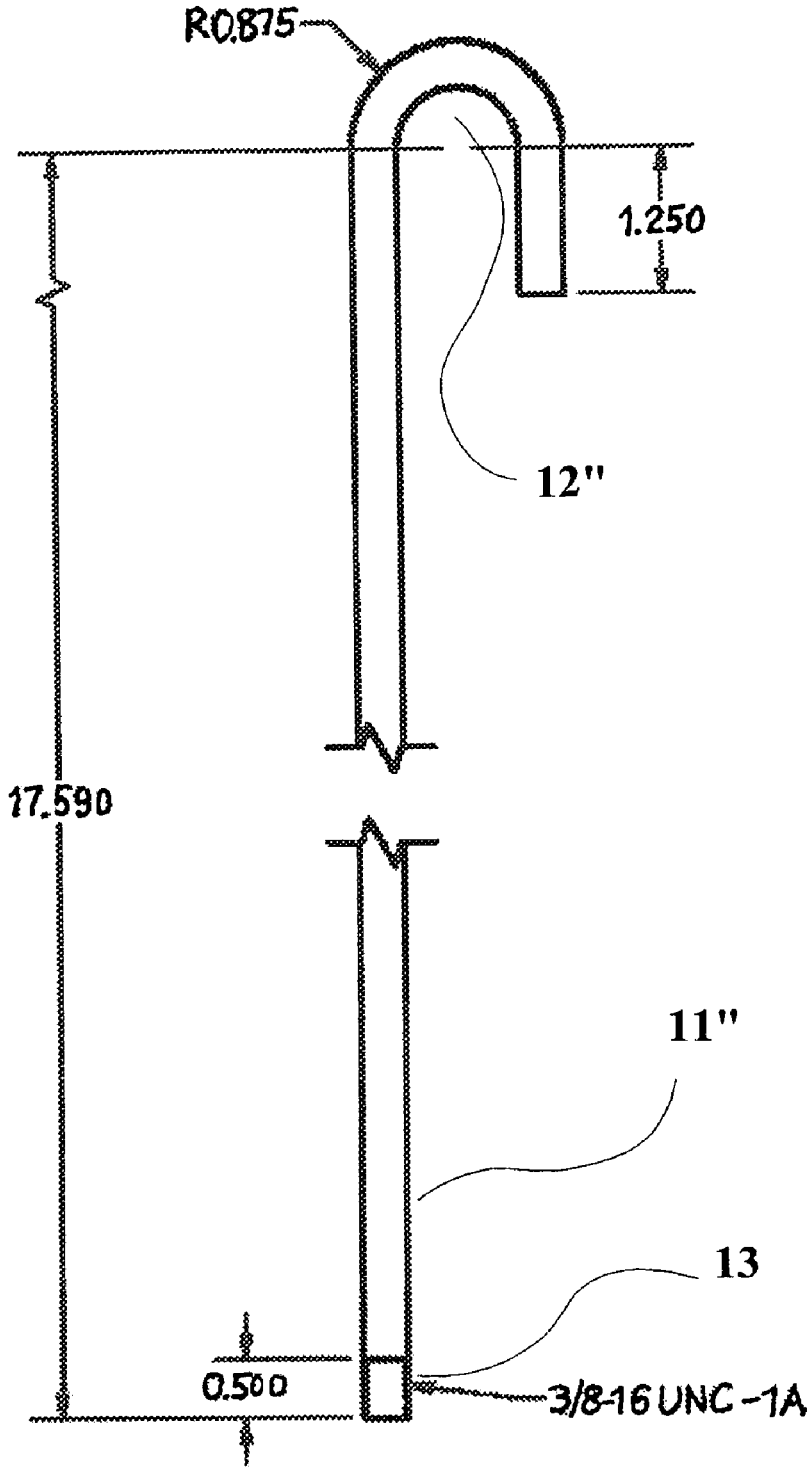
FIG. 8 shows an another alternative embodiment of the hook portion of the present invention.

21 Receiving bore of head
22 Chamfer at ends of head
23 Knurling about head
24 Cylinder bore of handle
25 Knurling about handle
26 Small bore in lock nut for rod
27 Large bore in lock nut for handle
28 Threading in large bore of lock nut
29 Gripping portion of lock nut
30 Tapered end of lock nut
31 Knurling about gripping portion of lock nut
32 Tapered end of wedge lock
33 Bore of wedge lock
34 Middle portion of wedge lock
35 Base portion of wedge lock
36 Split in wedge lock
37 Threading of nut
38 Fixed washer portion of nut
39 Piston wall portion of fixed washer
40 Hammer face of head FIG. 1 shows the multi-purpose trucker's power-puller tool 10 of the present invention. The tool 10 is formed of a handle 17 with cylindrical bore (24 as seen in FIG. 3), in which a hook rod 11 slides. A solid steel cylindrical head 20 has a face 40 for thumping truck tires to determine whether they have too little pressure. A handle 17 is attached to the head 20, and a lock nut 14 can hold the rod 11 in position. A hook 12 at the end of the rod 11 can be used for several tasks, such as grabbing fifth wheel pin, the eyelet of a cover, or a chain. The hook shown in FIGS. 1 and 8 is a crook 12", which is suitable for grabbing a fifth wheel pin. The crook will not let go of the fifth wheel pin when the trucker prepares to yank the pin, which is a problem with the acute angle hook design shown in the '494 and '603 design patents. Alternatively, the hook shown in FIG. 2 is an acute angle hook 12, which is suitable for grabbing and pulling covers over a truck load. Alternatively, the hook shown in FIG. 7 is a right angle hook 12', which is suitable for miscellaneous pulling tasks, such as grabbing and pulling chain a cross a truck bed or from under a truck.

Figure 5:
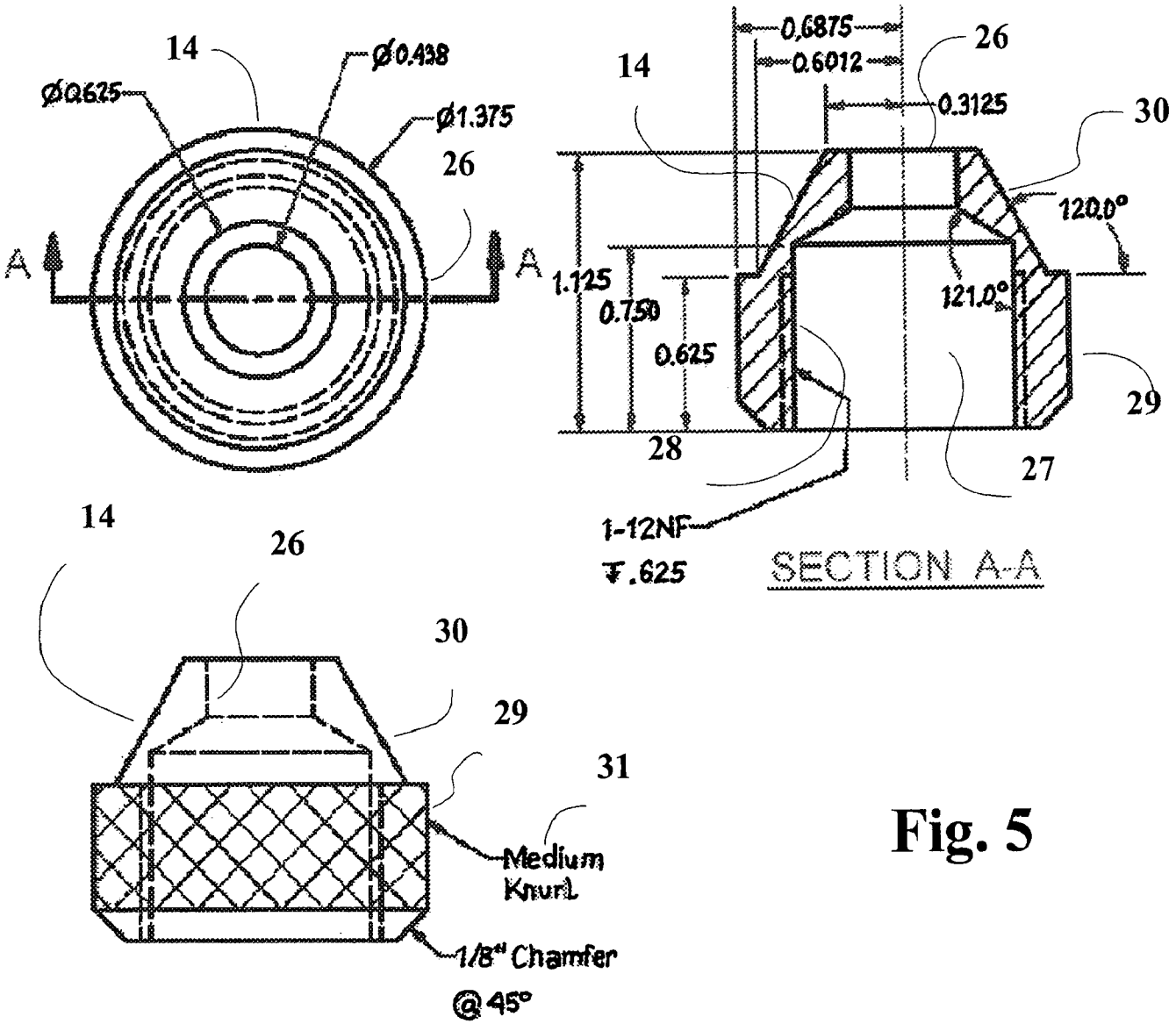
FIG. 5 shows three views of the lock nut portion of the present invention.

FIG. 2 is an exploded view of the multi-purpose trucker's power-puller tool 10 of the present invention. The solid steel cylindrical head 20 has a bore 21 to receive an end 19 of the handle 17. The end 19 may then be welded to the head 20, or connected to the head 20 in any other suitable way, such as by threads or a pin. A lock nut 14 at the open end 18 of the handle 17 allows the rod 11 to slide in the handle 17. The lock nut 14 may be threaded (28, as seen in FIG. 5), so as to be screwed onto a threaded end 18 of the handle 17. A wedge lock 15 in the lock nut 14 will lock the rod 11 in place. A nut 16 at an end 13 of the rod 11 will stop the rod 11 against the wedge lock 15 and keep the rod 15 from sliding out. The nut 16 may be threaded onto the end 13 of the rod 11.

Figure 4:
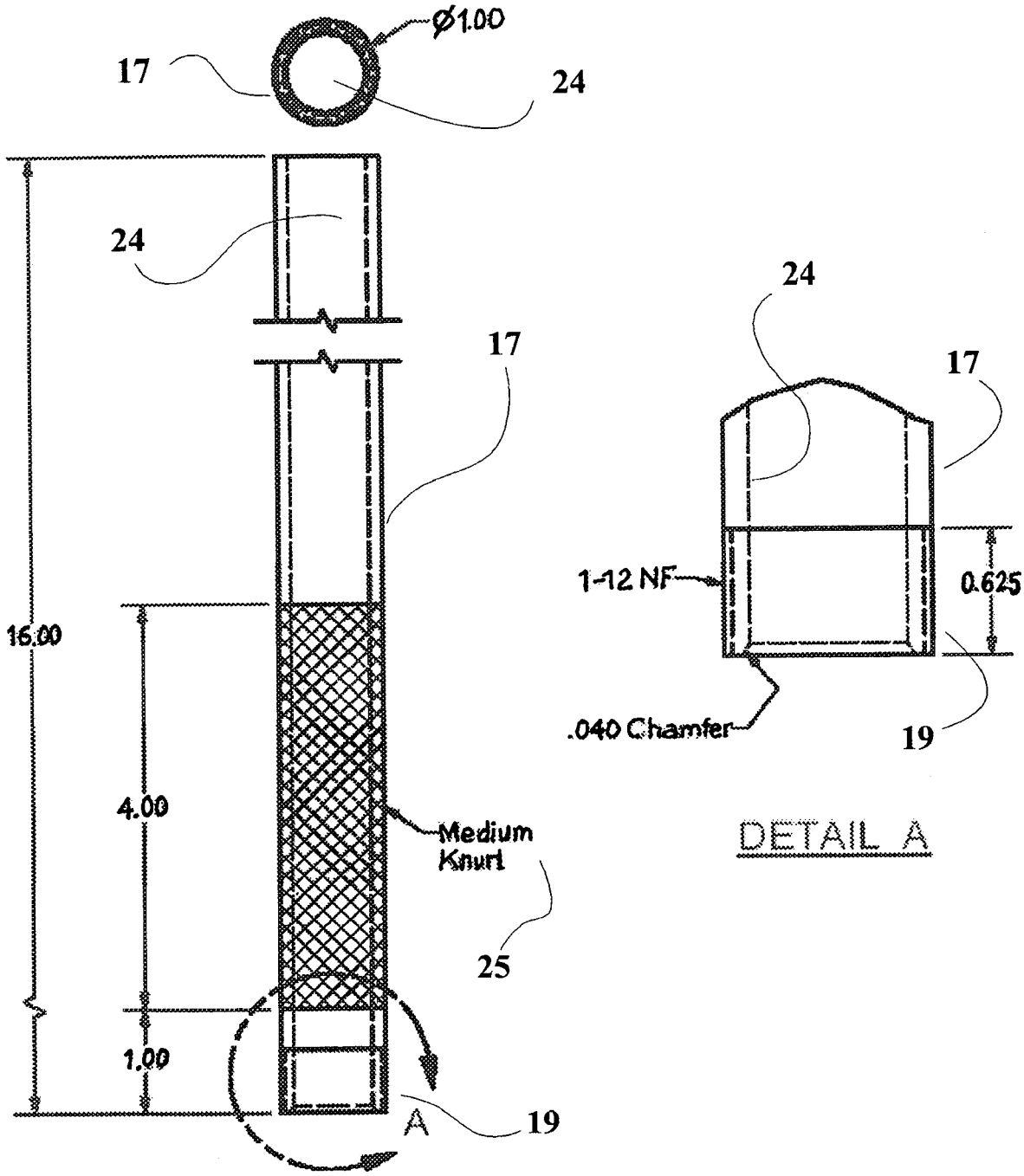
FIG. 4 shows three views of the handle portion of the present invention.

It will be understood from the drawings that the hook rod 11 may slide within the cylindrical bore (24, as seen in FIG. 4) of the handle 17, and the nut 16 at the end of the rod 11 will stop against the wedge lock 15. The weight of the head 20, which is preferable made of sold steel, may be used to provide substantial momentum in pulling any object grabbed by the hook 12. For example, a truck's fifth wheel pin will often wear or become rusty and hard to pull out. The crook 12" may be inserted in the fifth wheel pin and the trucker can yank the head 20 and handle 17 until the wedge lock 15 rams against the rod nut 16, thereby exerting significant force upon the pin to pull it free.

FIG. 3 shows detail of the design of the head 20. In alternative embodiments, the head 20 can have knurling 23 to aid gripping. The head 20 has a flat face 40, like that of a hammer, for thumping truck tires to determine whether they are low in pressure, a common trucker practice that requires a heavy hammer-like tool. Chamfering 22 about the face 40 eliminates sharp edges, which could be harmful to the trucker or the tire.

FIG. 4 shows detail of the handle 17. From this figure it will be seen that the handle 17 has a cylindrical bore 24. The head end 19 can be machined down to fit into a bore (21, as seen in FIG. 2) of the head 20, which may have a slightly smaller dimension than the outside of the handle 17. Knurling 25 about the handle 17 can provide additional grip.

Figure 6:
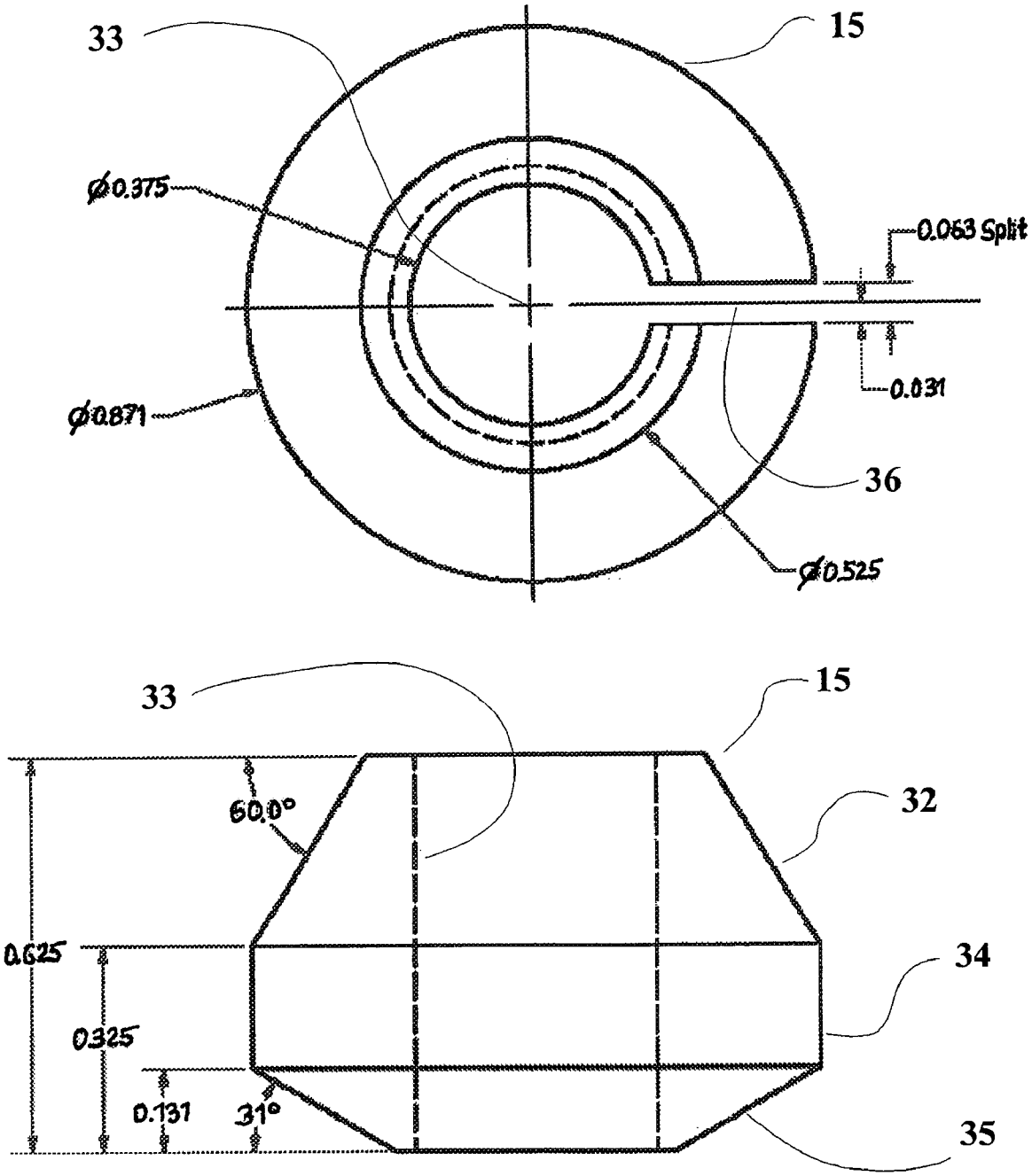
FIG. 6 shows two views of the wedge lock portion of the present invention.

FIG. 5 shows detail of the lock nut 14. The larger opening 27 will receive the handle 17 and may have internal threads 28 to receive external threads at the end 18 of the handle 17. A smaller opening 26 at the other end of the lock nut 14 is a bore that will allow the rod 11 to slide in the handle 17. The lock nut 14 is tapered 30 to receive the wedge lock 15, as described below. In a preferred embodiment, the gripping portion 29 of the lock nut 14 may have knurling 31 to aid gripping. FIG. 6 shows detail of the wedge lock 15, which fits in the lock nut 14. The wedge lock 15 has a bore 33 in which the rod 11 may slide or be gripped. The middle portion 34 of the wedge lock 15 is received in the larger opening 27 of the lock nut, and the taper 32 of the wedge lock 15 fits against the taper 30 of the lock nut 14. A radial split 36 in the wedge lock 15 allows it to be squeezed by the taper 30 of the lock nut 14, exerting substantial pressure at the bore 33 against the rod 11, thereby locking the rod in place. This locking feature is useful for locking the tool 10 in an extended position or in a collapsed position. For example, to use the acute angle hook 12 to grab an eyelet of a cover on top of a trailer, it is necessary to lock the rod 11 in an extended position, so that it will not slide back under the force of gravity when lifted vertically. Or, when storing the tool 10, it is useful to lock it in a collapsed position.

FIGS. 7 and 8 show alternative embodiments of the hook rod 11' or 11". As described above, hook rod 11' has a right angle hook 12', which is suitable for reaching and pulling objects, such as chain, without hooking them. Also as described above, hook rod 11" has a crook 12", which is especially suitable for grabbing and pulling a fifth wheel pin. Also described above, is the acute angle hook (12, as seen in FIG. 2), which is especially useful for grabbing and pulling an eyelet of a cover. It will be appreciated that the interchangeability of the hook rod 11, as disclosed herein, allows other hook 12 designs to be used with this tool 11.

Figure 9:
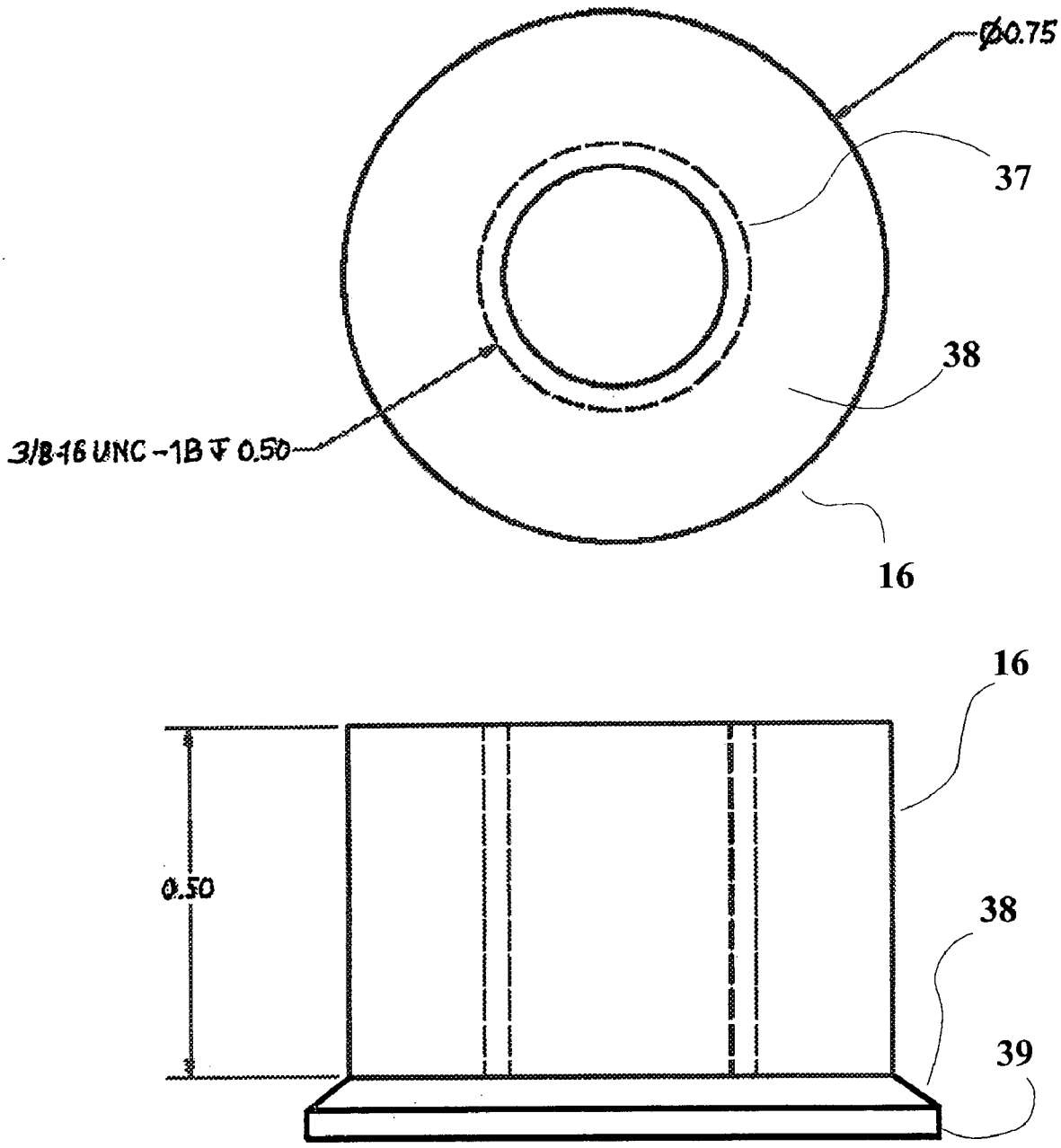
FIG. 9 shows two views of the nut portion of the present invention.

FIG. 9 shows detail of the nut 16 which keeps the rod 11 in the handle 17. The nut 16 has internal threads 37 for screwing onto an end 13 of the hook rod 11. In a preferred embodiment, a fixed washer 38 has an edge 39 that acts like a piston to ride in and help locate the rod 11 in the cylindrical bore 24 of the handle 17.

The drawings and description set forth here represent only some embodiments of the invention. After considering these, skilled persons will understand that there are many ways to make a multi-purpose trucker's power puller tool according to the principles disclosed. The inventor contemplates that the use of alternative structures, which result in a multi-purpose trucker's power puller tool using the principles disclosed and the invention claimed, will be within the scope of the claims.

The invention claimed is:

1. A trucker's multi-purpose puller tool comprising:

an elongated hollow cylindrical handle having an open end, a head end, and an elongated handle portion between the open end and the head end, a heavy hammer head mounted transversely at the head end of the handle, an elongated hook rod slidably received in the open end of the elongated hollow cylindrical handle, the hook rod further comprising a hook end, a distal end, and an elongated rod portion between the hook end and the distal end, a stop nut connected to the distal end of the hook rod, and a lock nut at the open end of the handle, the lock nut further comprising a bore slidably receiving the elongated rod portion of the hook rod, a chamber and a stopping face within the chamber, wherein the stopping face is sized to receive and stop the stop nut of the hook rod.

2. The trucker's multi-purpose puller tool of claim 1 further comprising a wedge lock sized to fit within the chamber of the lock nut at the stopping face, wherein the wedge lock further comprises a bore to receive and squeeze the rod portion of the hook rod.

3. The trucker's multi-purpose puller tool of claim 2 wherein the open end of the handle has external threads and the lock nut is threadably received by the external threads of the handle, and wherein the bore of the wedge lock is progressively squeezed against the rod portion of the hook rod when the lock nut is threaded onto the external threads of the handle.

4. The trucker's multi-purpose puller tool of claim 1 wherein the hook end of the hook rod is a crook.

5. The trucker's multi-purpose puller tool of claim 1 wherein the hook end of the hook rod is a right angle hook.

6. The trucker's multi-purpose puller tool of claim 1 wherein the hook end of the hook rod is an acute angle hook.

7. The trucker's multi-purpose puller tool of claim 1 wherein the handle portion of the elongated hollow cylindrical handle has an external surface, and wherein the external surface comprises a knurled gripping portion.

8. The trucker's multi-purpose puller tool of claim 1 wherein the transverse hammer head has an external surface, and wherein the external surface of the hammer head comprises a knurled gripping portion.

9. A multi-purpose puller tool comprising:

a hollow cylindrical handle having an open end, a head end, and a handle portion between the open end and the head end, a metal head at the head end of the handle, a rod received by the open end of the hollow cylindrical handle, the rod further comprising a hook end forming a hook, a stop end, and a rod portion between the hook end and the stop end, a stop at the stop end of the rod, and a removable locking fastener at the open end of the handle, the locking fastener further comprising a bore slidably receiving the rod portion of the hook rod and a stopping face, wherein the stopping face is sized to stop the stop of the hook rod.

10. The multi-purpose puller tool of claim 9 wherein the hook is a crook.

11. The multi-purpose puller tool of claim 9 wherein the hook is a right angle hook.

12. The multi-purpose puller tool of claim 9 wherein the hook is an acute angle hook.

13. The multi-purpose puller tool of claim 9 further comprising a plastic wedge lock having a bore sized to squeeze the rod portion of the hook rod, and having a conical end and a radial slit, and wherein the lock nut further comprises an interior chamber having a conical face sized to receive the conical end of the wedge lock.

14. A multi-purpose puller tool comprising:

a hollow handle having an open end, a head end, and a handle portion between the open end and the head end, a transverse metal head at the head end of the handle, a rod received by the open end of the hollow handle, the rod further comprising a hook end, a distal end, and a rod portion between the hook end and the distal end, a removable locking fastener at the open end of the handle, the locking fastener further comprising a means to slidably receive the rod portion of the hook rod and to stop the hook rod.

* * * * *